US005950638A

United States Patent [19]

Crosta

[11] Patent Number: 5,950,638

[45] Date of Patent: Sep. 14, 1999

[54] HERMETICALLY SEALED CONTAINER, IN PARTICULAR FOR COSMETICS PRODUCTS SUCH AS MAKE-UP

[75] Inventor: Sergio Crosta, Venegono Inferiore, Italy

[73] Assignee: Laffon S.p.A., Italy

[21] Appl. No.: 09/027,589

[22] Filed: Feb. 23, 1998

[30] Foreign Application Priority Data

Mar. 20, 1997 [IT] Italy ..... MI97A0634

[51] Int. Cl.[6] ..... A45D 33/00

[52] U.S. Cl. ..... 132/293; 215/341

[58] Field of Search ..... 132/293, 300, 132/301, 304, 305; 215/234, 341, 350, 351

[56] References Cited

U.S. PATENT DOCUMENTS

| | | | |
|---|---|---|---|
| 2,116,421 | 5/1938 | Williams | 215/341 |
| 3,664,535 | 5/1972 | Mette | 215/341 |
| 4,586,519 | 5/1986 | Seidler et al. | 132/293 |
| 4,747,500 | 5/1988 | Gach et al. | 215/341 |
| 5,542,561 | 8/1996 | Slink et al. | 132/293 |
| 5,707,823 | 1/1998 | Carr et al. | 215/341 |
| 5,761,506 | 8/1998 | Sheffler et al. | 215/341 |

FOREIGN PATENT DOCUMENTS

| | | | |
|---|---|---|---|
| 562965 | 9/1993 | European Pat. Off. | 132/293 |
| 2539968 | 8/1984 | France | 132/293 |

*Primary Examiner*—Todd E. Manahan
*Attorney, Agent, or Firm*—Hedman, Gibson & Costigan, P.C.

[57] ABSTRACT

A hermetically sealed container, in particular for cosmetics products, comprises an outer casing, consisting of a base (11) on which a lid (12) is positioned in a freely removable manner. According to the invention, from a part of said lid (12) there extends integral therewith an elastic gasket (16) which exerts a hermetic sealing action against an opposing surface (18) of said base (11).

7 Claims, 1 Drawing Sheet

HERMETICALLY SEALED CONTAINER, IN PARTICULAR FOR COSMETICS PRODUCTS SUCH AS MAKE-UP

This invention relates to a hermetically sealed container, in particular for cosmetics products such as make-up.

The container concerned is a container commonly used in the health and beauty sector, of the type comprising an outer casing in which an element for containing the cosmetics product, commonly known as a pan, is located.

Certain of these cosmetics products, which are under continuous development, currently contain volatile substances for instantly fixing the cosmetics product, such as rouge or colour base.

These products also have the advantage that because of their particular nature, they do not soil.

However, the volatile nature of these added substances places a limit on the resultant cosmetics product. In this respect, it is apparent that if the volatile component of the cosmetics product evaporates, the product no longer maintains the particular and advantageous characteristics resulting from this added substance. It has to be remembered, inter alia, that after their production and before reaching the final user, such products are generally stored for a long time. This makes it even more important to maintain the integrity and quality of a cosmetics product, especially if it includes a volatile substance.

It has been attempted to solve this problem by constructing interchangeable sealed inserts or pans for cosmetics product containers, to be inserted into the container.

This solution also has evident limits in that, once the seal has been removed and the insert or pan has been inserted into the container, the problem immediately returns and the product rapidly degrades.

Again, it has been attempted to find a solution by introducing a gasket between the lid and the insert or pan, which operates each time the container is closed.

This solution is however also not permanent because the gasket, initially sized for proper sealing, tends not to provide a continuous sealing action because of cold molecular creep of the component plastic materials of the entire container and of the elements contained in it. Hence those parts under stress partly lose their dimensional stability with time.

The general object of the present invention is to solve the aforelisted technical problems in an extremely simple, economical and particularly functional manner.

A particular object of the present invention is to solve said problems within a make-up container, generally provided with a transparent lid.

Said objects are attained by a hermetically sealed container, in particular for cosmetics products, having the characteristics defined in the accompanying claims.

The structural and functional characteristics of the present invention and its advantages over the known art will be more apparent from an examination of the following description given with reference to the accompanying drawings, which show examples of container constructed in accordance with the invention. On the drawings.

Figure 3:
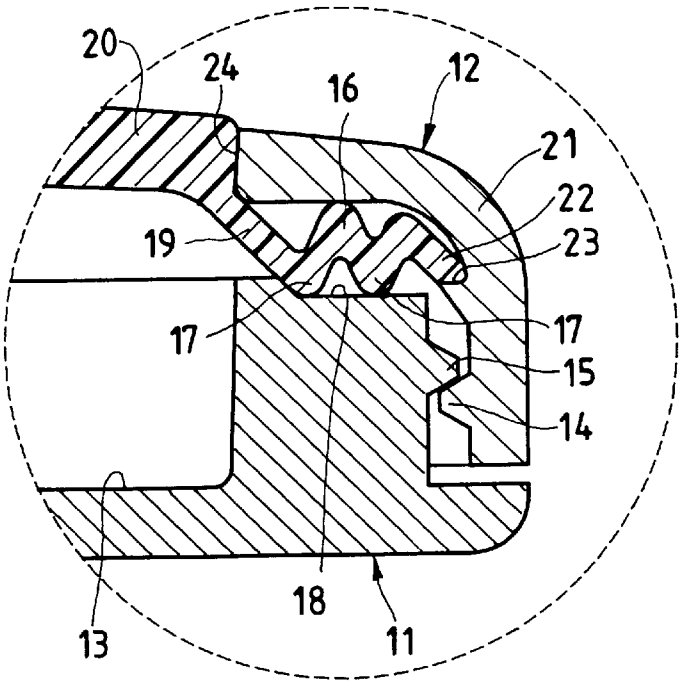
FIG. 3 is an enlarged section showing the seal region of the container of FIGS. 1 and 2.

With reference to the drawings, the hermetically sealed container of the invention is indicated overall by 10, and is of round shape in the illustrated possible embodiment. The container 10 comprises a base 11 on which a lid 12 is positioned in a freely removable manner, to together form the outer casing, inside which—in the seat 13 in the base 11—there is placed an insert or pan (not shown).

The casing can be of a shape other than the round shape shown by way of non-limiting example.

In the illustrated embodiment the lid 12 is screwed onto the base 11 by threads 14, 15, the hermetic seal being obtained according to the present invention by a perimetral gasket 16 characteristically formed on the lid 12.

For this purpose the gasket 16 is elastically yieldable and is provided with seal lips 17 which act on an opposing sealing surface 18 of the base 11.

Figure 1:
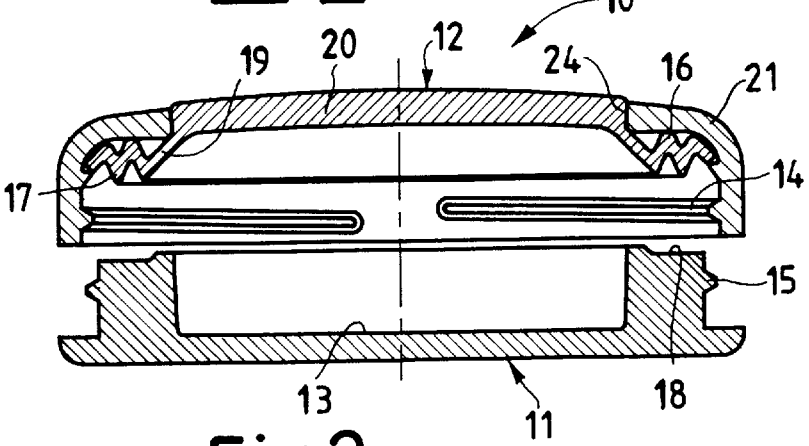
FIG. 1 is a view of a hermetically sealed container, in particular for cosmetics products such as make-up, according to the invention, in its open position.
Figure 2:
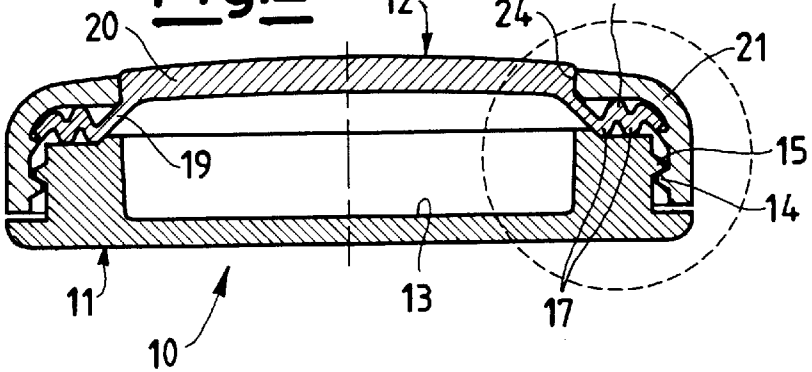
FIG. 2 is a view of the container of FIG. 1 in its closed position.

In the non-limiting embodiment shown in FIGS. 1–3, the gasket 16 is formed integrally with an elastically yieldable tapered annular collar 19 of a central part 20 of the lid 12, this central part being snap-fitted into a perimetral threaded ring 21 constituting the supporting section of the lid 12.

The central part 20 is fitted into the perimetral ring 21 by forcing the ring 21 onto the part 20 in correspondence with the conical contact surfaces 24. On fitting the parts 20 and 21 together, an edge section 22 of the elastic gasket 16 abuts against a ledge 23 on the ring 21.

In the case of make-up containers, the central part 20 is preferably transparent, to enable the contained product to be viewed without opening the container.

According to the invention, the lid 12 could also be formed in one piece comprising the seal gasket 16.

From the aforegoing description it is apparent that on screwing the lid 12 onto the base 11, the elastic gasket 16, suitably dimensioned for this purpose, exerts via its lips 17 and the edge section 22 a perfect seal against the surface 18 of the base 11. Practical tests have shown that the construction of the invention ensures a perfect hermetic seal with time, preventing any escape of volatile substance.

The object stated in the introduction to the description is hence attained.

The various container components can naturally assume the most widespread shapes, even quite different from those shown by way of non-limiting example on the drawings.

The scope of protection of the invention is consequently defined by the accompanying claims.

The Italian priority application No. MI97A 000634 is herein incorporated by reference.

I claim:

1. A hermetically sealed container for cosmetics products comprising an outer casing, consisting of a base (11) having an opposing surface (18) on which a lid (12) is positioned in a freely removable manner, characterized in that said lid (12) includes a integral elastic gasket (16) which exerts a hermetic sealing action against said opposing surface (18) of said base (11) said elastic gasket (16) having two lips which are spaced apart from one another on said elastic casket and form a hermetic seal when said lips (17) contact said opposing surface (18).

2. A container as claimed in claim 1, characterized in that said gasket (16) is provided with lips (17) which seal against said surface (18).

3. A container as claimed in claim 1, characterised characterized in that said gasket (16) is formed integrally with an elastically yieldable tapered annular collar (19) of central part (20) of said lid (12), said central part being applied to a threaded support ring (21) which screws onto the base (11).

4. A container as claimed in claim 3, characterized in that said gasket (16) comprises an edge section (22) which abuts against a ledge (23) of the ring (21).

5. A container as claimed in claim 1, characterized in that said gasket (16) is formed integrally with a central part (20) of said lid (12), this central part being applied to a threaded support ring (21) which screws into the base (11).

6. A container as claimed in claim 5, characterized in that said central part (20) is force-fitted into said ring (21).

7. A container as claimed in claim 5, characterized in that said central part is transparent.

* * * * *